US006980109B2

(12) United States Patent
Hoenig

(10) Patent No.: US 6,980,109 B2
(45) Date of Patent: Dec. 27, 2005

(54) SYSTEM AND METHOD FOR MONITORING INTRUSION DETECTION IN A POOL

(75) Inventor: Robert Hoenig, Nashua, NH (US)

(73) Assignee: AquaSonus, LLC, Lowell, MA (US)

( * ) Notice: Subject to any disclaimer, the term of this patent is extended or adjusted under 35 U.S.C. 154(b) by 77 days.

(21) Appl. No.: 10/697,143

(22) Filed: Oct. 30, 2003

(65) Prior Publication Data

US 2005/0093706 A1 May 5, 2005

(51) Int. Cl.[7] ..... G08B 13/00
(52) U.S. Cl. ..... 340/566; 340/573.6; 367/199; 367/136; 367/157
(58) Field of Search ..... 340/573.6, 566, 340/531, 539, 539.1; 367/199, 136, 157

(56) References Cited

U.S. PATENT DOCUMENTS

| | | | | |
|---|---|---|---|---|
| 3,732,556 A | | 5/1973 | Caprillo et al. | |
| 3,810,146 A | | 5/1974 | Lieb | |
| 3,867,711 A | * | 2/1975 | Ruscus | 367/136 |
| 4,121,200 A | | 10/1978 | Colmenero | |
| 4,747,085 A | | 5/1988 | Dunegan et al. | |
| 4,772,876 A | * | 9/1988 | Laud | 340/539.22 |
| 5,023,593 A | | 6/1991 | Brox | |
| 5,043,705 A | | 8/1991 | Rooz et al. | |
| 5,049,859 A | | 9/1991 | Arnell | |
| 5,091,714 A | | 2/1992 | De Solminihac | |
| 5,121,104 A | | 6/1992 | Nelson et al. | |
| 5,144,285 A | | 9/1992 | Gore | |
| 5,146,208 A | * | 9/1992 | Parra | 340/573.6 |
| 5,153,859 A | * | 10/1992 | Chatigny et al. | 367/140 |
| 5,369,623 A | | 11/1994 | Zerangue | |
| 5,563,580 A | * | 10/1996 | Stephens | 340/541 |
| 5,638,048 A | | 6/1997 | Curry | |
| 5,903,218 A | * | 5/1999 | Nelson | 340/573.6 |
| 5,959,534 A | * | 9/1999 | Campbell et al. | 340/573.6 |
| 6,127,936 A | * | 10/2000 | Gendel et al. | 340/692 |
| 6,583,724 B1 | * | 6/2003 | Rodriguez | 340/573.6 |

FOREIGN PATENT DOCUMENTS

| | | |
|---|---|---|
| AU | A-21727/88 | 3/1989 |
| GB | 1033458 | 6/1966 |

OTHER PUBLICATIONS

Thomas Henderson, The Nature of a Sound Wave 1996, The Physics Classroom, http://www.glenbrook.k12.il.us/gbssci/phys/Class/sound/u11l1c.html.*

MG International, "Aquasensor" Aquasensor reference found on internet prior to filing date (2003).

* cited by examiner

*Primary Examiner*—Daniel Wu
*Assistant Examiner*—Travis Hunnings
(74) *Attorney, Agent, or Firm*—Fish & Richardson P.C.

(57) ABSTRACT

A pool monitoring system includes a hydrophone configured to generate an electrical signal in response to receiving a pressure wave in the liquid of a pool, and a processor configured to receive the electrical signal and generate a trigger signal, when the electrical signal includes a characteristic signature over a time period within a predetermined range of time periods.

22 Claims, 15 Drawing Sheets

SYSTEM AND METHOD FOR MONITORING INTRUSION DETECTION IN A POOL

BACKGROUND

Swimming pools can be a hazard when left unattended. Some swimming pool monitoring systems sound an alarm when an unauthorized or accidental entry of an object or individual into a pool occurs. Some systems use water pressure measurement devices in conjunction with diaphragms to detect the pressure differential in the water due to movement of the water. Other systems use infrared or acoustic sensors to detect movement of the water. In some systems, an electronic circuit incorporating probes spaced apart above the water can detect a momentary splash. Other systems use a transmitter, for example, worn on a child to set off an alarm if the child enters the water.

SUMMARY

In a general aspect of the invention, a pool monitoring system includes a hydrophone configured to generate an electrical signal in response to receiving a pressure wave in the liquid of a pool, and a processor configured to receive the electrical signal and generate a trigger signal, when the electrical signal includes a characteristic signature over a time period within a predetermined range of time periods.

Implementations of the invention may include one or more of the following features.

The processor is configured to determine a trigger level from a background noise level by setting a gain of an electrical circuit based on background noise in the electrical signal.

The characteristic signature includes a first frequency component, contained in a frequency spectrum of the electrical signal, within a low band with a magnitude above the trigger level, and a second frequency component, contained in the frequency spectrum, within a high band with a magnitude above the trigger level. The low band includes a continuous band of frequencies that is a subset of the range 500 Hz to 2 kHz.

The high band includes a continuous band of frequencies that is a subset of the range 2.5 kHz to 5 kHz.

The predetermined range of time periods consists of time periods less than 4 seconds and greater than 0.5 seconds.

The system can also include a first filter configured to pass the first component if the first component is within the low band, and a second filter configured to pass the second component if the second component is within the high band. The first filter and the second filter can be electrical circuits. Alternatively, the electrical signal can be digitized, the frequency spectrum can be calculated based on the digitized electrical signal, and the first filter and the second filter can include processor instructions that operate on the calculated frequency spectrum.

The hydrophone comprises a piezo-electric material composed of lead zirconate titanate ceramic or polyvinylidene fluoride polymer film.

The system can also include a poolside horn configured to generate a sound in response to the trigger signal, a first antenna configured to periodically send radio-frequency status signals, one or more monitor units which include a second antenna configured to receive the radio-frequency status signals, and a monitor horn configured to generate a sound in response to the trigger signal. The monitor units are configured to indicate reception of the radio-frequency status signals.

In another general aspect of the invention, a pool intrusion detection method includes generating an electrical signal in response to receiving a pressure wave in the liquid of a pool, and generating a trigger signal in response to receiving the electrical signal when the electrical signal includes a characteristic signature over a time period within a predetermined range of time periods.

Implementations of the invention may include one or more of the following features.

The pool intrusion detection method can include storing a count of false alarms. The false alarms include receiving the electrical signal when the electrical signal includes a noise signature that is different from the characteristic signature, or receiving the electrical signal when the electrical signal includes a noise signature over a time periods that is not within the predetermined range of time periods.

The pool intrusion detection method can also include adjusting the trigger level in response to the count of false alarms increasing above a predetermined number, or adjusting the center frequencies of the low band and the high band in response to the count of false alarms increasing above a predetermined number.

Among the advantages of the invention are one or more of the following. The pool monitoring system is capable of distinguishing between movement in the water caused by noise, such as wind or rain, and movement in the water due to entry of an object into the water, such as a person. The pool monitoring system is capable of distinguishing between entry into the water of an object such as a person, and entry into the water of objects such as leaves or branches.

Other features and advantages of the invention will become apparent from the following description, and from the claims.

DESCRIPTION

Figure 1:
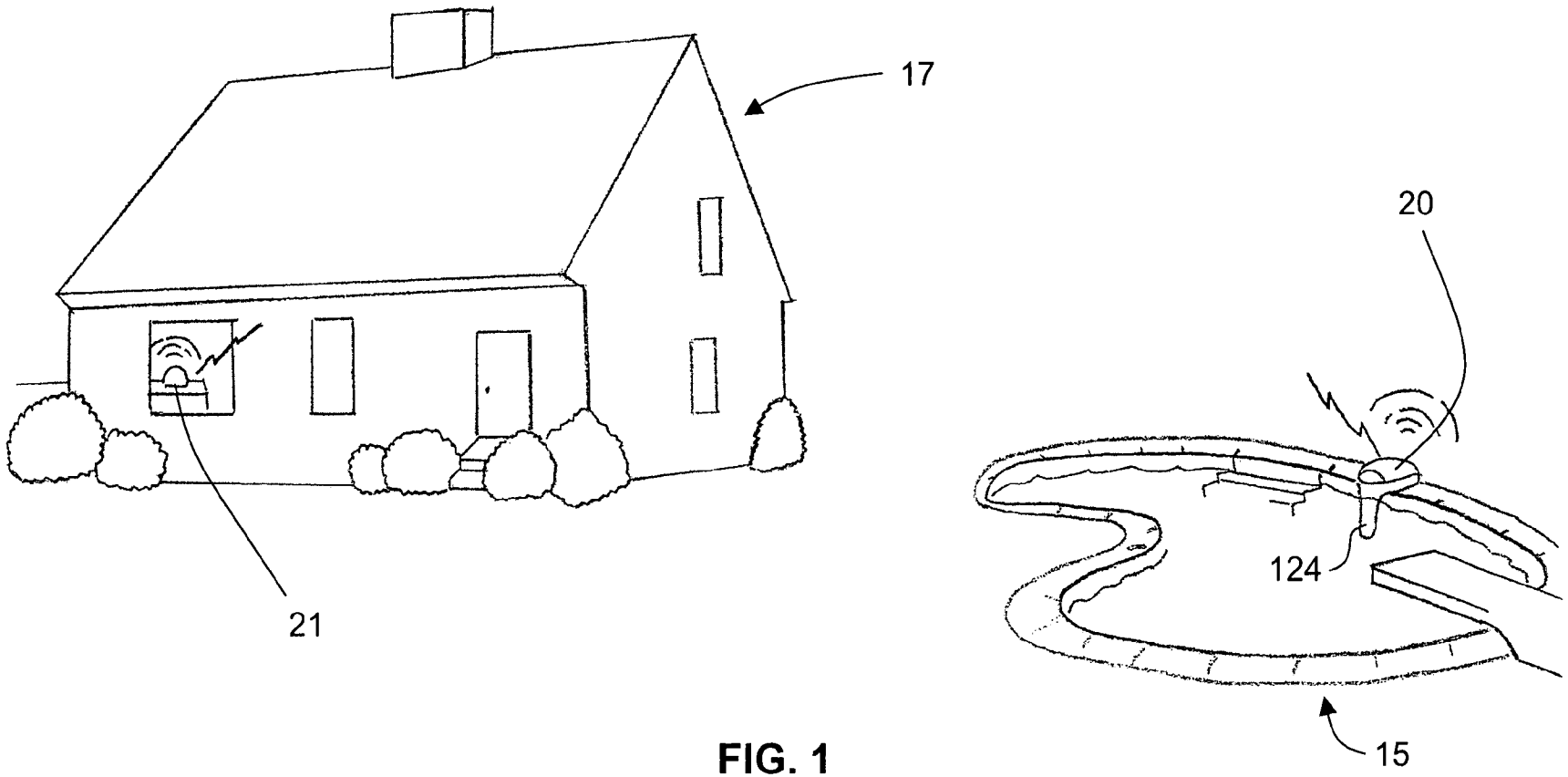
FIG. 1 shows a pool monitoring system installed in a swimming pool.

FIG. 1 shows a typical swimming pool environment with a pool monitoring system installed. The pool monitoring system includes a poolside unit 20 having a hydrophone 124 (FIG. 10) which is positioned under the water within a swimming pool 15. The hydrophone 124 generates an electrical signal in response to sound pressure waves present in the pool. This electrical signal is processed by signal processing electronics within the poolside unit 20 to determine the presence of signal characteristics indicating that an intrusion event has occurred in the pool. The signal processing electronics uses both frequency spectrum and time domain analysis to differentiate false alarm noise sources from actual intrusion events.

The poolside unit 20 contains an audible alarm circuit which is activated when an intrusion event is detected. The poolside unit 20 also communicates to one or more monitor units 21 via radio-frequency (RF) signals. An RF transmitter in the poolside unit 20 sends information to an RF receiver in the monitor unit 21 positioned, for example, in a house 17 proximal to pool 15. This information is processed in the monitor unit 21 and used to control the audible alarm circuit in the monitor unit 21 which is activated when an intrusion event is detected. The monitor unit 21 also contains indicators for the status of other system functions such as battery condition and self-test results. The poolside unit is battery powered. The monitor unit 21 is powered by an AC power line and includes a battery back-up function in the event of AC power failure.

Figure 2:
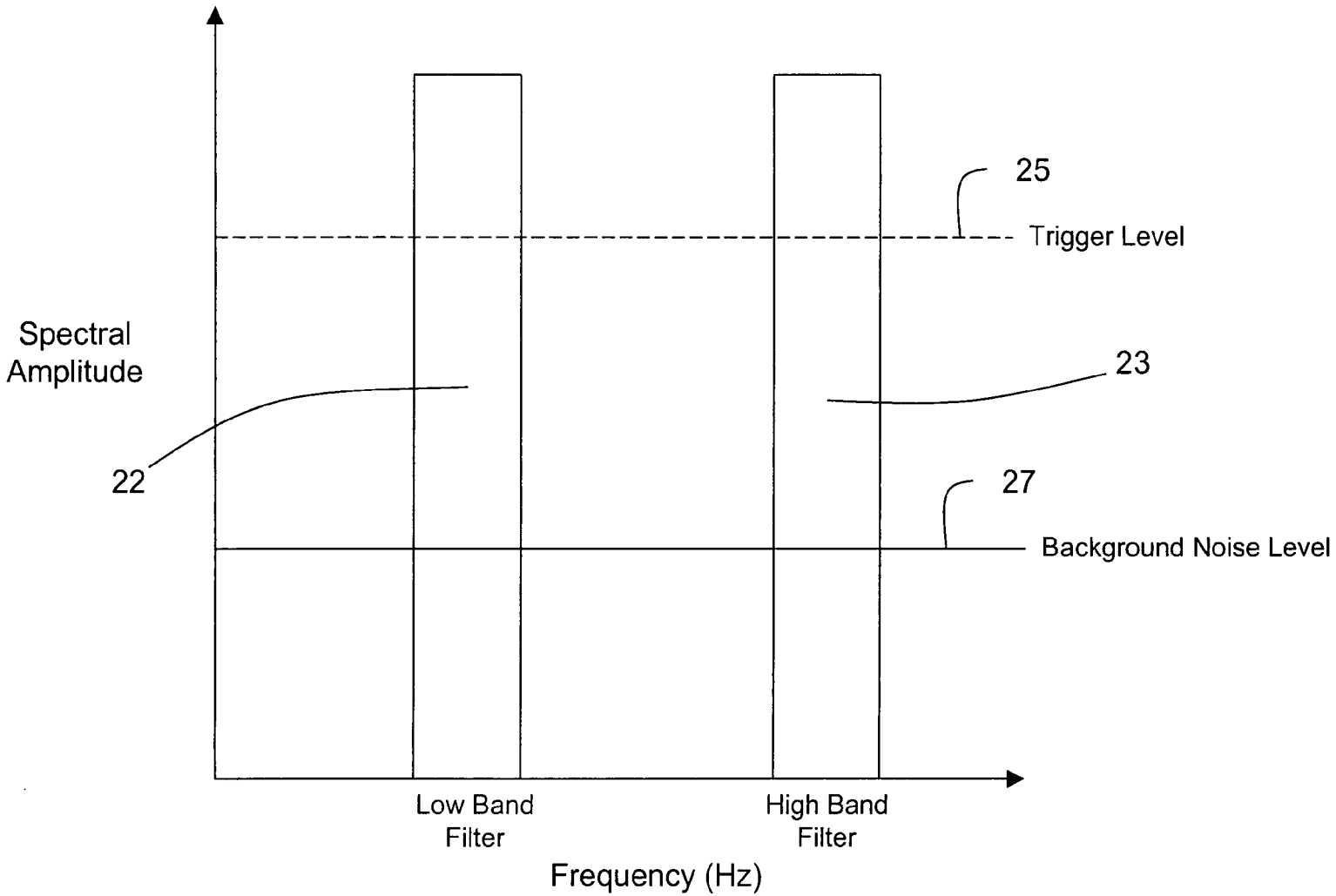
FIG. 2 shows pass bands for low and high band bandpass filters and trigger and background noise signal levels associated with a hydrophone of the pool monitoring system.

The spectral amplitude of the electrical signal detected by hydrophone 124 is tested over two different frequency ranges by the signal processing electronics. FIG. 2 shows pass bands of two bandpass filters used by the signal processing electronics to detect an intrusion event. The pass band 22 of a low band filter has a center frequency within the range of 500 Hz to 2 kHz. The pass band 23 of a high band filter has a center frequency within the range of 2.5 kHz to 5 kHz. The signal processing electronics in the poolside unit 20 includes a processor (e.g., a microprocessor) that determines a trigger level 25 that is above a background noise level 27 for both bandpass filters. The processor determines that a candidate electrical signal corresponds to a possible intrusion event when the spectral amplitude of the candidate electrical signal is simultaneously above the trigger level for frequencies within the low pass band 22 and for frequencies within the high pass band 23. If a candidate electrical signal qualifies as a possible intrusion event by having this characteristic signature, the processor tests the time envelope of the candidate electrical signal to determine whether the possible intrusion event is a valid intrusion event.

Figure 3:
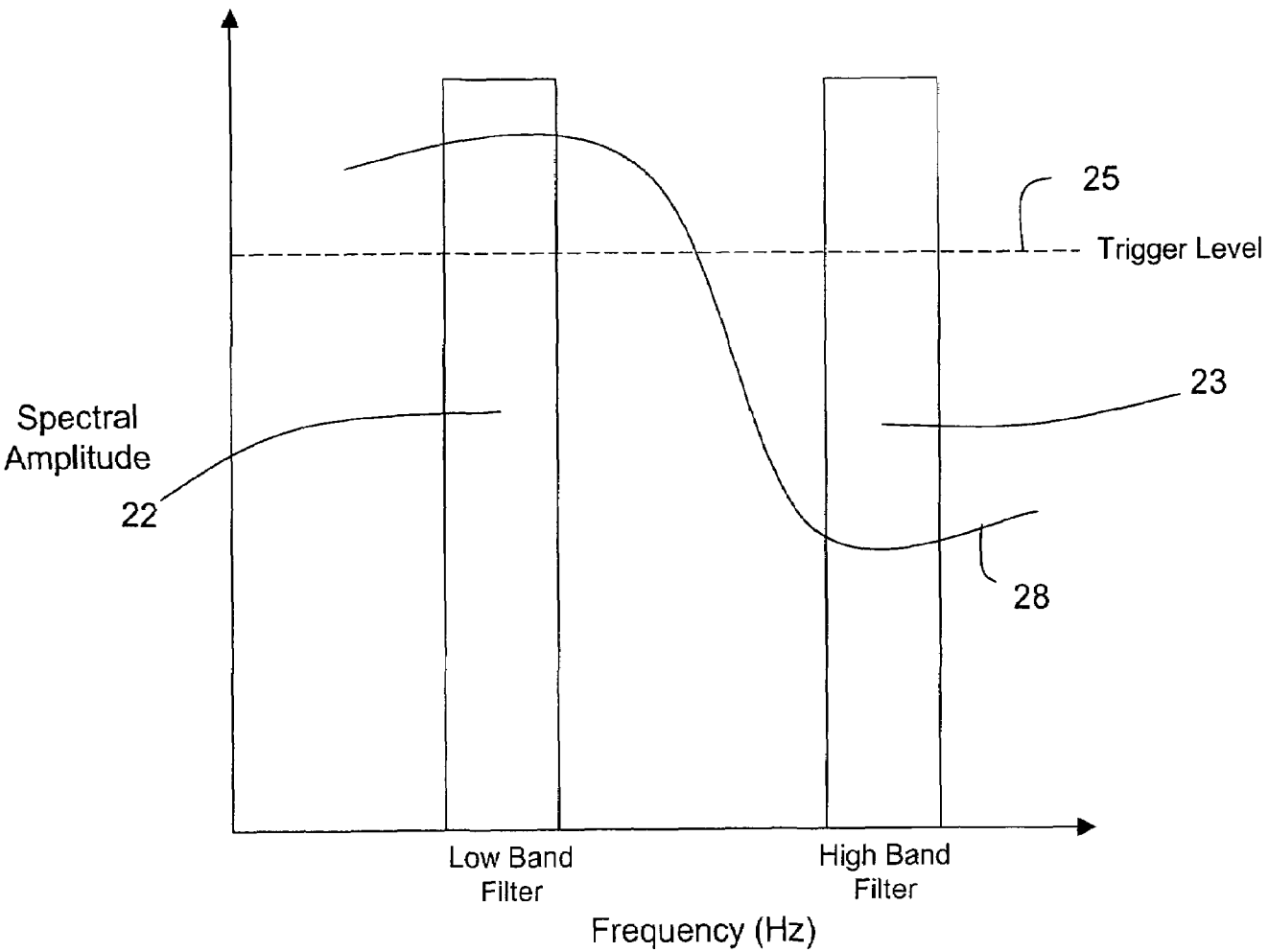
FIG. 3 shows a signal frequency spectrum for a low frequency event.

FIG. 3 shows a typical electrical signal spectral amplitude for a noise event 28 dominated by low frequencies. Such events include wind, pump noises and footfall sounds. These are false alarm sounds which do not correspond to an intrusion event because the spectral amplitude registered by the high frequency bandpass filter is below the trigger level 25.

Figure 4:
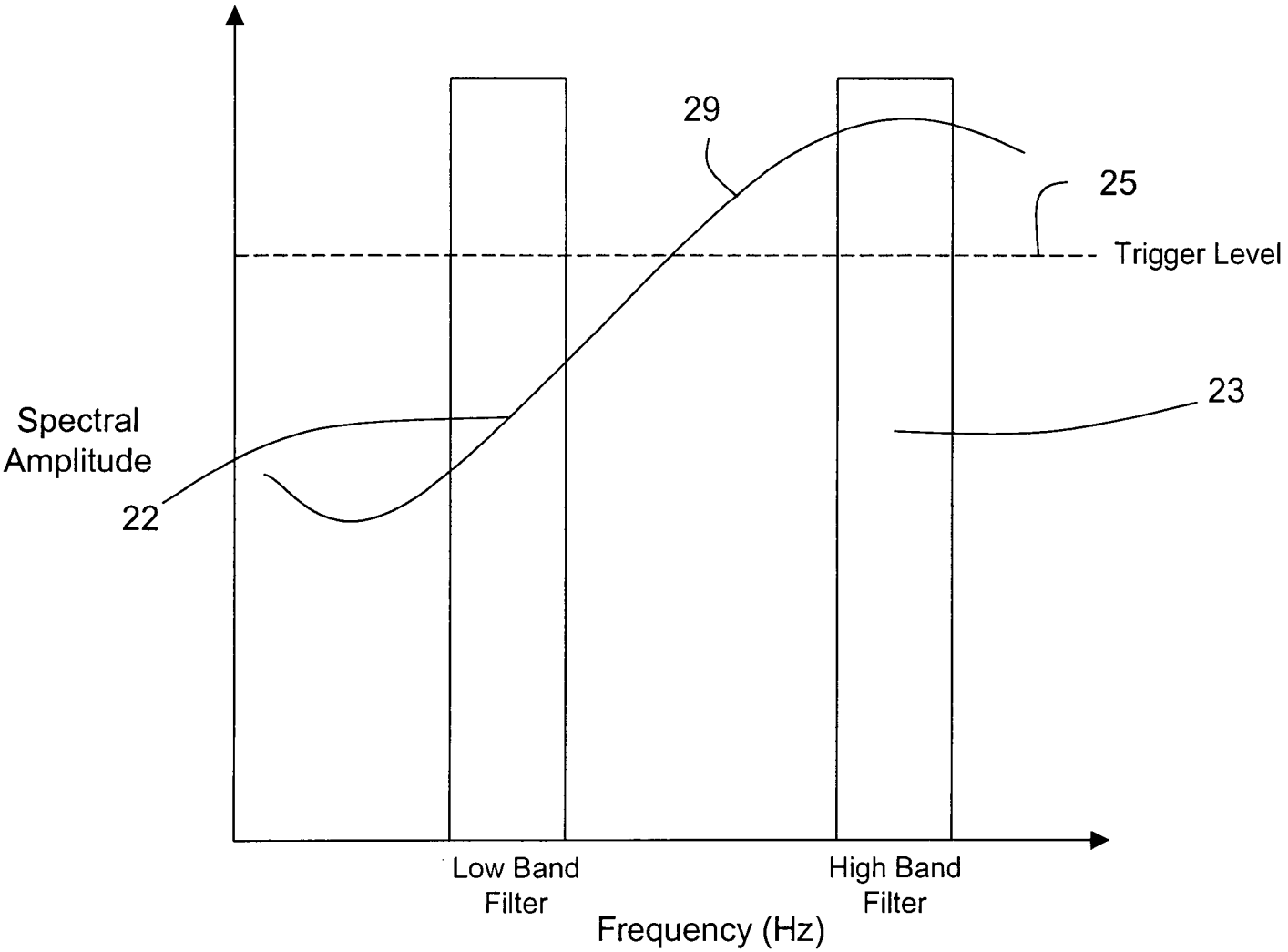
FIG. 4 shows a signal frequency spectrum for a high frequency event.

FIG. 4 shows a typical electrical signal spectral amplitude for a noise event 29 dominated by high frequencies. Such events include rain and light weight objects such as a beach ball falling into the pool. These are false alarm sounds which do not correspond to an intrusion event because the spectral amplitude registered by the low frequency bandpass filter is below the trigger level 25.

Figure 5:
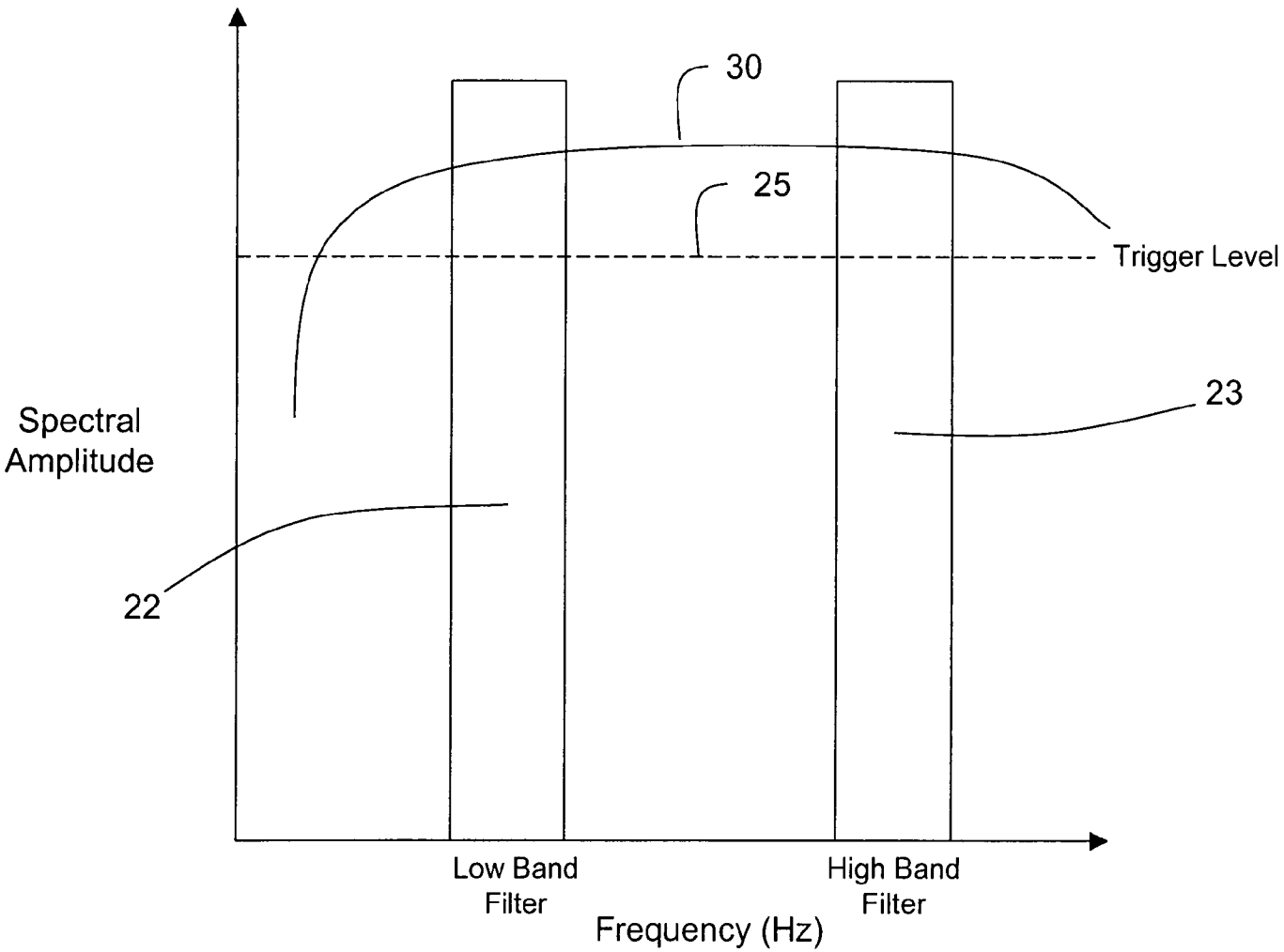
FIG. 5 shows a signal frequency spectrum for a possible intrusion event.
Figure 6:
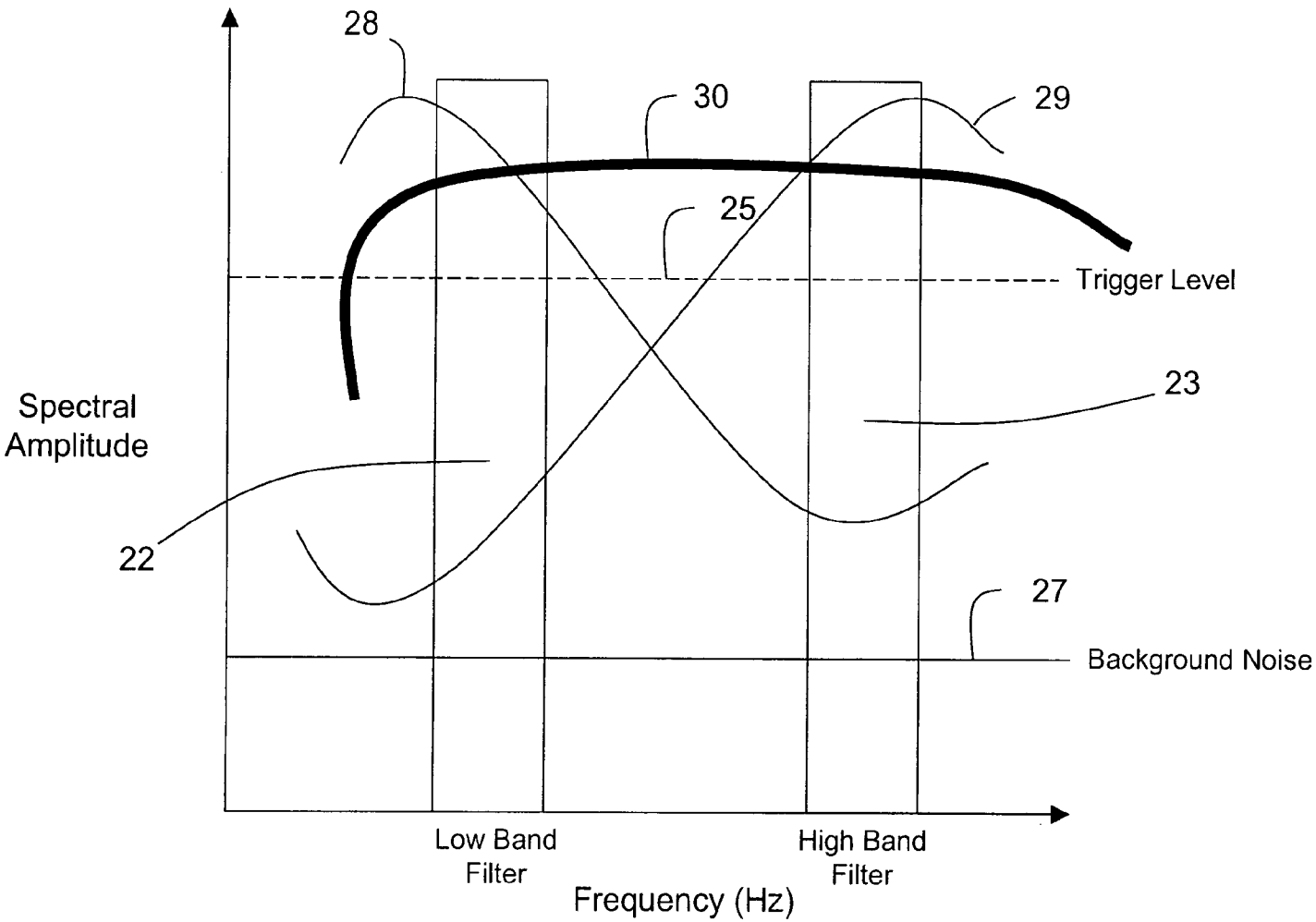
FIG. 6 illustrates the differences between false alarm event frequency spectra and a possible intrusion event frequency spectrum of FIGS. 3–5.

FIG. 5 shows a typical electrical signal spectral amplitude for a possible intrusion event 30. In this case, the spectral amplitude registered by both bandpass filters is above the trigger level 25. FIG. 6 combines the plots of spectral amplitudes from FIGS. 3–5 to illustrate the differences between the false alarm event frequency spectra 28 and 19 and a possible intrusion event frequency spectrum 30.

After a candidate electrical signal has been qualified as a possible intrusion event, by virtue of the spectral amplitude of the candidate electrical signal being above the trigger level for frequencies within the low pass band 22 and frequencies within the high pass band 23, the candidate electrical signal is further tested in a "time envelope test." A valid intrusion event presents a wideband signal (according to the characteristic signature described above) which is above the trigger level at both low and high bands for a time period that is within a predetermined range of time period (e.g., 1–2 seconds).

Figure 7:
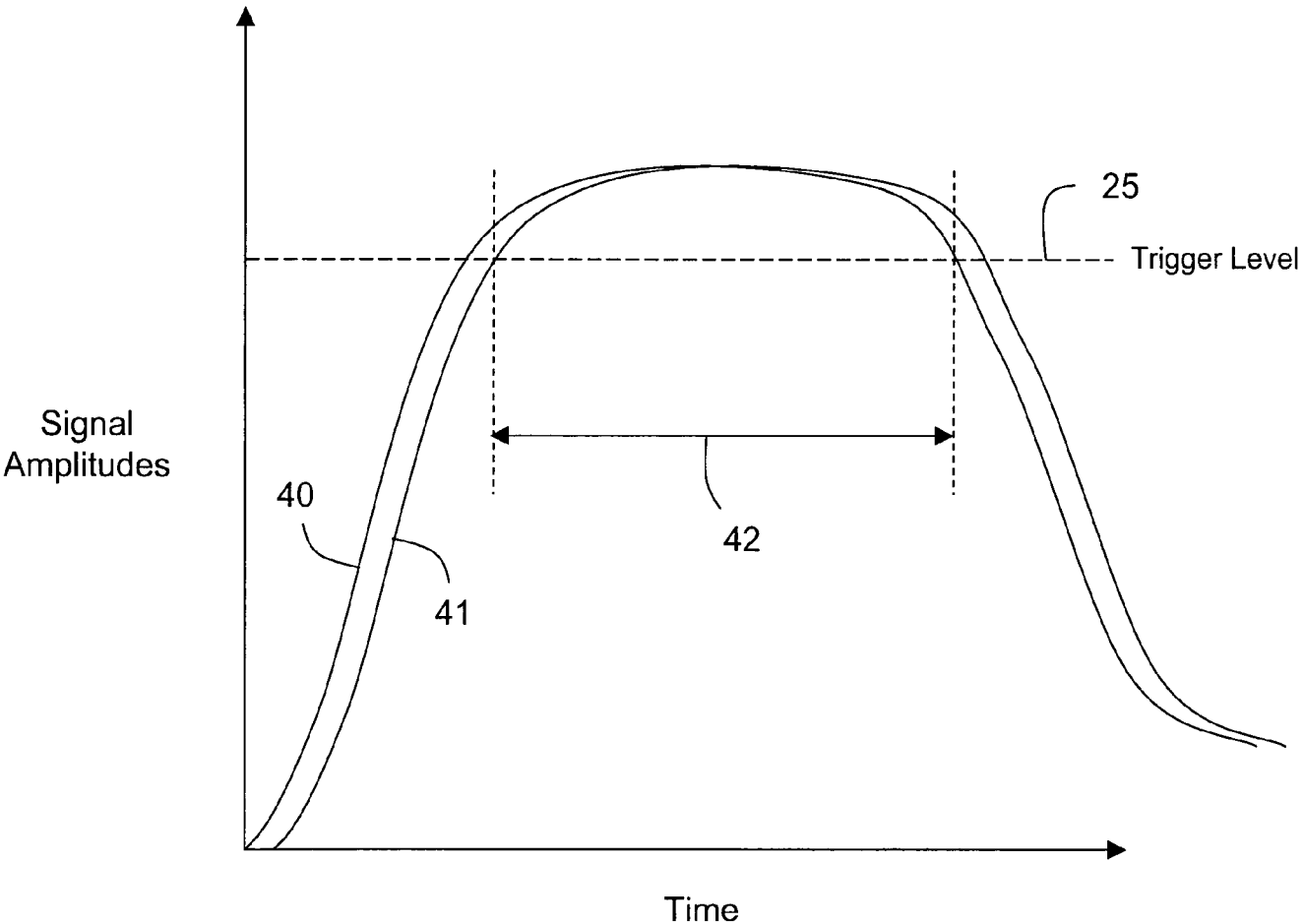
FIG. 7 shows signal amplitudes for spectral components of a possible intrusion event.

FIG. 7 shows signal amplitudes for filtered spectral components of a candidate electrical signal as a function of time. A signal amplitude 40 of a spectral component within the low passband 22 and a signal amplitude 41 of a spectral component within the high passband 23 are both above the trigger level 25 over a time period 42 (as measured by the processor). The candidate electrical signal corresponds to a valid intrusion event if the time period 42 is within the predetermined range of 1–2 seconds.

Figure 8:
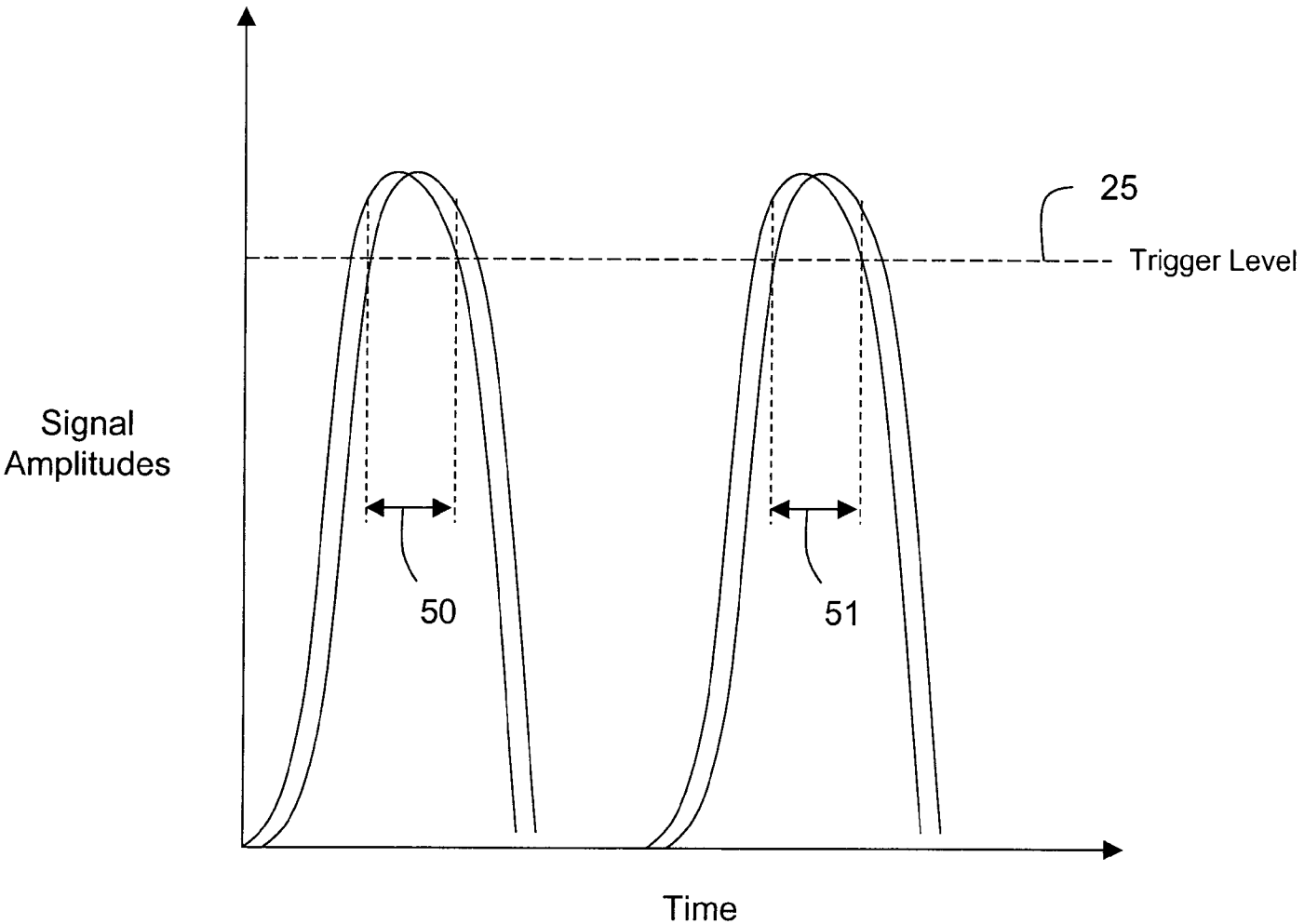
FIG. 8 shows signal amplitudes for spectral components of impulse events.

FIG. 8 shows signal amplitudes for a series of two impulse events which do not satisfy the minimum time period for a valid intrusion event. The time period 50 over which the first impulse event has both low and high spectral components over the trigger level 25, and the time period 51 over which the second impulse event has both low and high spectral components over the trigger level 25 are each less than 1 second.

Figure 9:
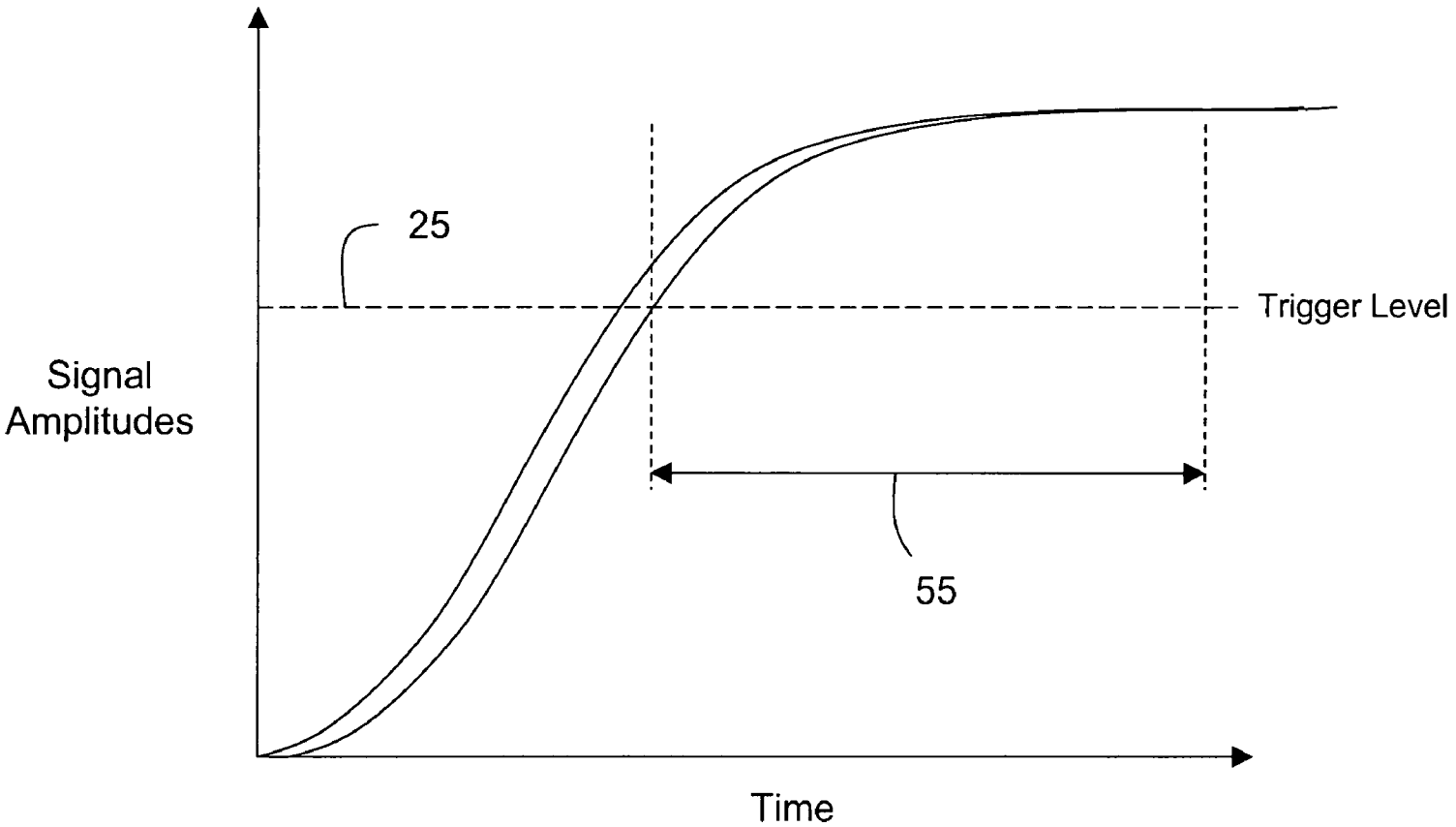
FIG. 9 shows signal amplitudes for spectral components of a long-term noise event.

FIG. 9 shows signal amplitudes for a long-term noise source which has spectral components that exceed the 2 second maximum time period for a valid intrusion event. After the processor measures a time period 55 that is longer than the maximum of the predetermined range, the processor determines that the possible intrusion event is not a valid intrusion event. In this case, if the long-term noise source has signal amplitudes that remain high (above or near the trigger level) for a predetermined amount of time (e.g., 1 minute) the processor changes the trigger level to ignore the long-term noise source. The trigger level returns to a lower level after the long-term noise source stops. If a candidate electrical signal has the characteristic signature over a time period within the predetermined range, it is considered a valid intrusion event and the processor sounds the alarm.

Figure 10:
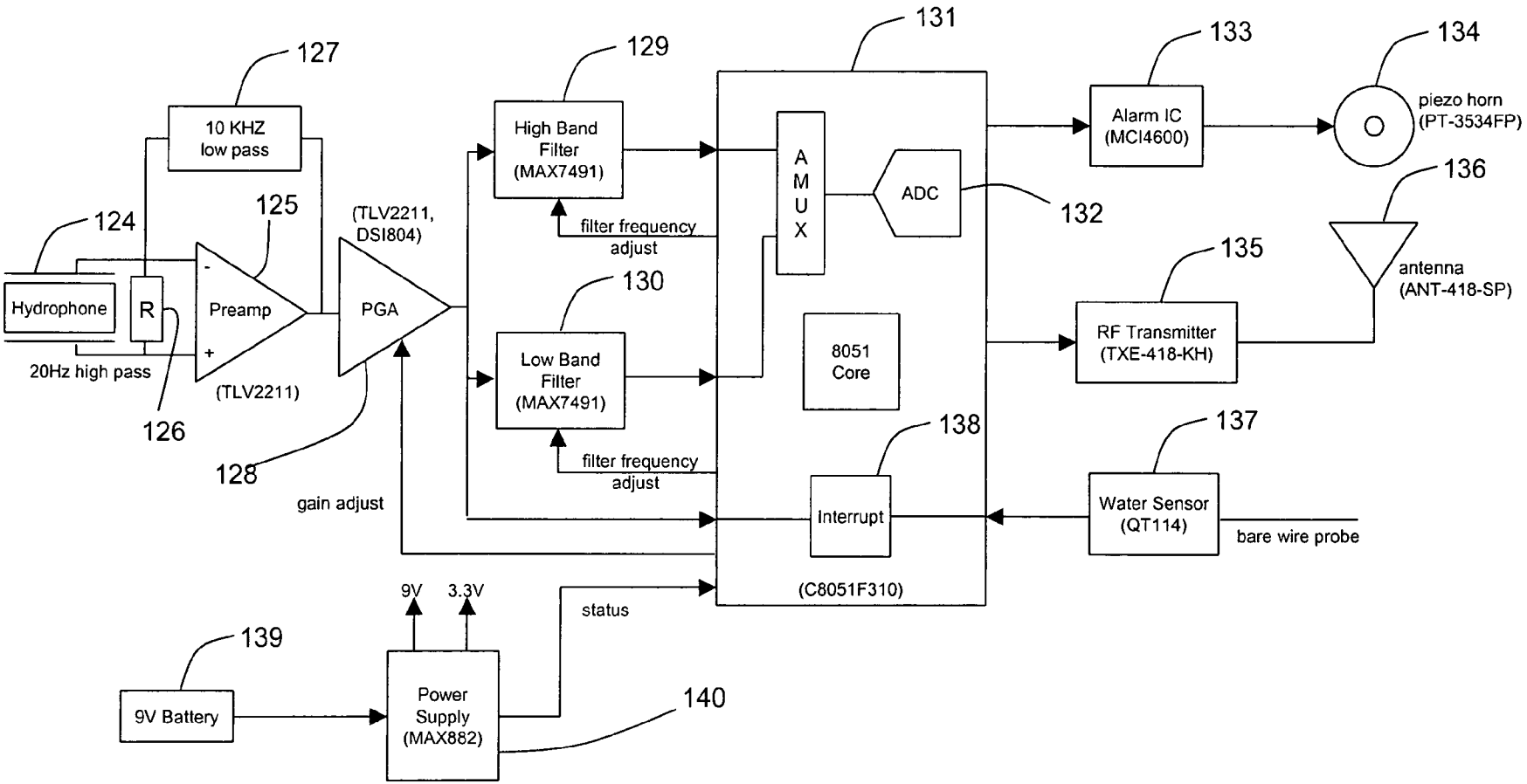
FIG. 10 is a block diagram of an implementation of the poolside unit.

FIG. 10 is a block diagram of an implementation of poolside unit 20. Sound pressure waves in the liquid of the pool are converted to electrical signals by a hydrophone 124. The hydrophone is constructed using a ceramic piezoelectric material such as lead zirconate titanate (PZT) or a piezoelectric polymer film such as polyvinylidene fluoride (PVDF). An electrical signal from the hydrophone is amplified by preamp 125. The preamp 125 is implemented using integrated circuit (IC) operational amplifier technology. The preamp 125 provides a voltage gain of between 200 and 2000 as appropriate for the choice of hydrophone 124. Two single pole RC filters are used to bandwidth limit the signal. A high pass filter, with a pole at 20 Hz is formed using a resistor 126 and the capacitance of the hydrophone 124. A low pass filter 127, with a pole at 10 kHz, is formed using a capacitor and the preamp 125 feedback resistor. The electrical signal is processed next by a programmable gain amplifier 128. This amplifier provides an adjustable gain of from 1 to 50 controlled by a microprocessor 131. By this mechanism, the overall sensitivity of the poolside unit 20 can be adjusted by software in the microprocessor 131 in response to changing conditions in the ambient noise level present in the pool.

The microprocessor 131 is the control mechanism for the poolside unit 20. Via software instructions, the microprocessor 131 sets the gain of the programmable gain amplifier 128 and sets the center frequencies of the two bandpass filters 129 and 130. The bandpass filters are implemented by switched capacitor filter integrated circuits. The high band filter 129 is a 4th order filter with a center frequency in the range 2.5 kHz to 5 kHz. The low band filter 130 is a 4th order filter with a center frequency in the range 500 Hz to 2 kHz. The outputs of the filters are converted from analog voltage levels to digital values by an analog-to-digital converter (ADC) 132.

Software instructions executed by the microprocessor 131 accumulate the digital values from the ADC 132 and calculate the root mean square (RMS) amplitude of a high pass filtered electrical signal spectral component and a low pass filtered signal spectral component. The microprocessor 131 uses the calculated RMS amplitudes of these low band and high band spectral components to detect the characteristic signature described above. The microprocessor 131 also performs the time envelope testing of a candidate electrical signal.

When a valid intrusion event is detected, the microprocessor 131 sounds an audible alarm by triggering an alarm IC 133. The alarm IC 133, for example, is of the type used in smoke detectors. The alarm IC drives a piezo horn 134 to produce a loud audible sound. The microprocessor 131 communicates to the monitor unit 21 (located, for example, in a house by the pool) via an RF transmitter 135. In addition to the state of the audible alarm, other information about the state of the poolside unit 20 can be communicated to the monitor unit 21 using the RF transmitter 135 and antenna 136. This information can include the state of a battery 139 that powers the poolside unit 20, the results of self-test operations performed by the microprocessor 131, and a periodic "heart-beat" transmission to test the communications link.

A water sensor 137 (e.g., a bare wire probe) informs the microprocessor 131 when the poolside unit 20 enters the water or leaves the water. This allows the microprocessor 131 to place the poolside unit 20 in a low power "sleep" mode to preserve battery life when the unit is not in the pool and therefore not in use. The raw signal level from the programmable gain amplifier 128 is also made available to the microprocessor 131 via the microprocessor's interrupt mechanism 138. This signal is used by the microprocessor to reduce power consumption when the raw signal level is below a threshold value.

Figure 11:
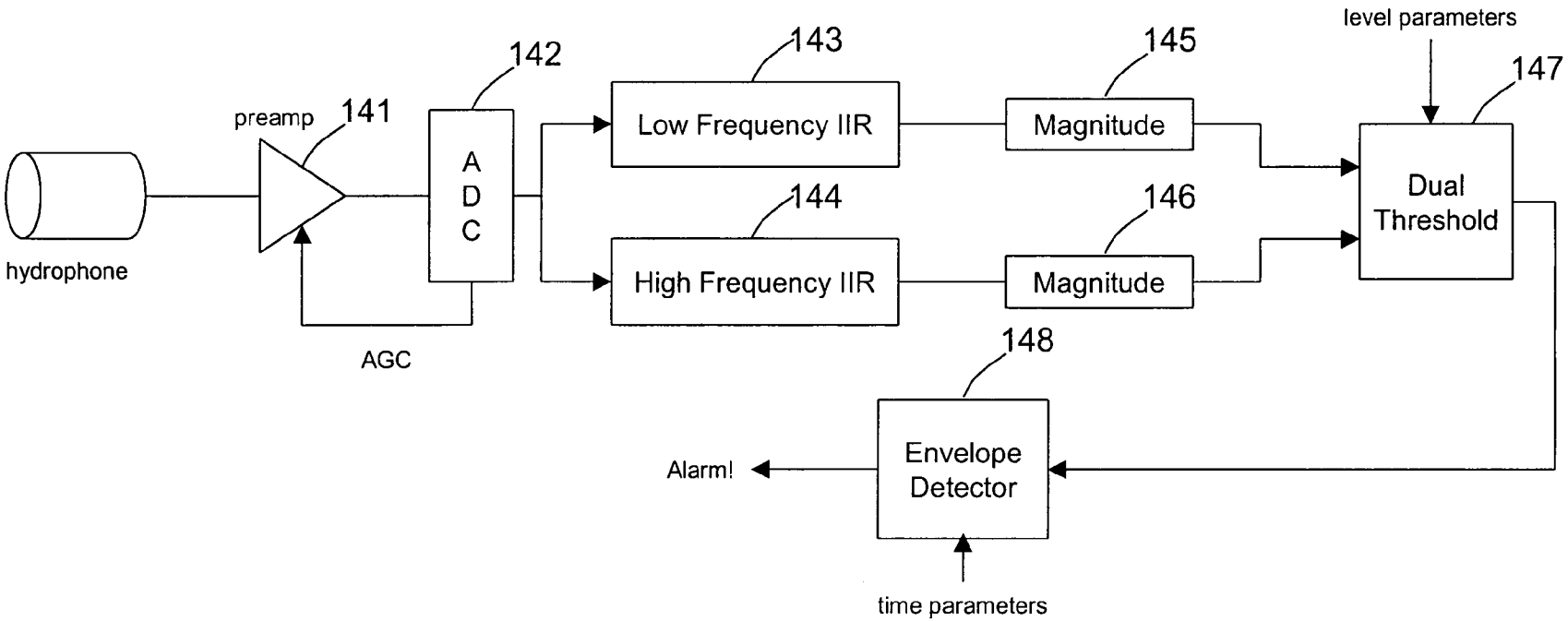
FIG. 11 is a block diagram of another implementation of the poolside unit.

The poolside unit 20 is powered by the battery 139. Operating voltage for the various integrated circuits is generated by switched mode power supply 140. A block diagram of alternative implementation of the poolside unit 20 is shown in FIG. 11. In this implementation, the output of a preamp 141 is presented directly to an ADC 142. Processor instructions are used to implement various software modules for the poolside unit 20. A low pass filter module 143 and a high pass filter module 144 are implemented as infinite impulse response (IIR) filters operating on the digital values output by the ADC 142. The processor calculates the RMS signal magnitude for the low pass module 143 in magnitude module 145, and for the high pass module 144 in a magnitude module 146. A dual threshold module 147 performs characteristic signature testing based on level parameters and an envelope detector 148 performs time envelope testing based on time parameters, as described above.

Figure 12:
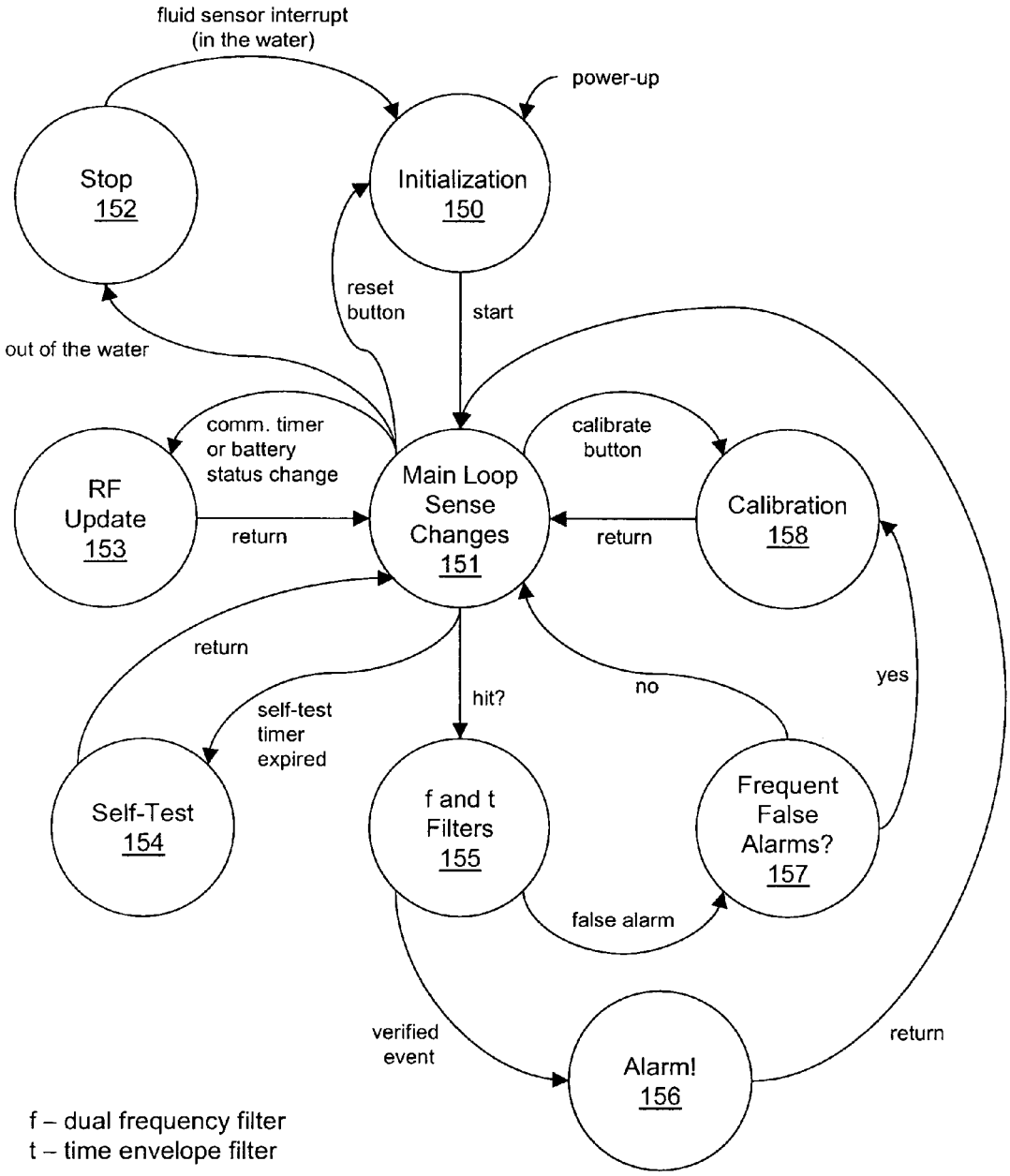
FIG. 12 is a state transition diagram for the poolside unit.

FIG. 12 is a state transition diagram showing the operation of the poolside unit 20. Upon power-up processor instructions initialize the hardware in an initialize state 150 and the unit 20 enters the main processing loop state 151. This loop responds to external events via the microprocessor's interrupt mechanism and by polling hardware status registers. A periodic timer interrupt, which occurs approximately every two minutes, is used to transition to an RF update state 153, trigger an RF transmission to the monitor unit 21, and return to the main loop state 151. This regular transmission enables the monitor unit 21 to report when the poolside unit 20 is not active using a timeout mechanism in the monitor unit 21. The RF update state 153 is also entered whenever the main loop senses a change in the alarm status, the poolside battery status, or the self-test result.

A sound pressure wave in the pool of sufficient magnitude will trigger the unit to enter state filter state 155 where the processor tests the outputs of the two bandpass filters for the characteristic signature and performs time envelope testing. Detection of a valid intrusion event will cause the alarm to be sounded in an alarm state 156. A false alarm will be counted in a false alarm state 157.

The processor counts the number of false alarms that occur between RF updates. If a maximum false alarm threshold is exceeded, a calibration state 158 will be entered. In the calibration state 158, the processor adjusts the sensitivity of the poolside unit 20 by controlling the gain setting of the programmable gain amplifier. The poolside unit 20 will also enter the calibration state 158 if a calibrate button is pressed. A self-test state 154 is entered every 30 minutes via a timer interrupt. In this state the processor executes instructions which use the programmable gain amplifier and the analog-to-digital converter to test the sensitivity of the system to ambient sound levels in the pool and insure that the bandpass filters are working properly. The results of the self-test are reported to the monitor unit 21 over the RF link.

If the poolside unit 20 is removed from the water, the water sensor will cause the poolside unit 20 to enter the stop state 152. This is a power down condition. When the unit 20 is placed back in the pool, the processor is notified via a reset interrupt and resumes processing from the initialization state 150. If a reset button is pressed, the poolside unit 20 enters the initialization state 150.

Figure 13:
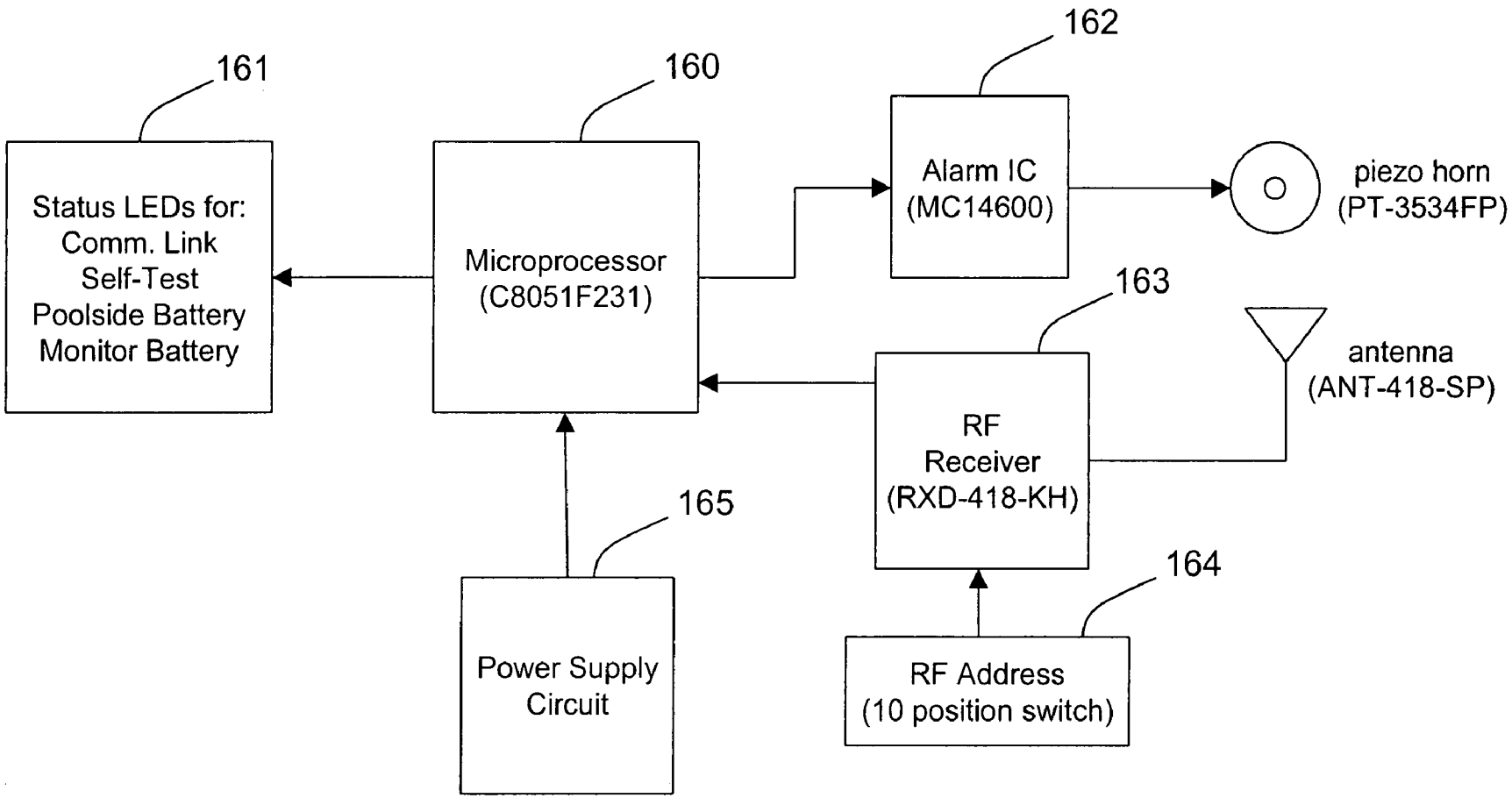
FIG. 13 is a block diagram of an implementation of the monitor unit.

FIG. 13 is a block diagram of an implementation of the monitor unit 21. A microprocessor 160 controls the operation of the monitor unit 21. The inputs for the monitor unit 21 come from an RF receiver circuit 163 and a power supply circuit 165. The RF receiver 163 receives data from the poolside unit 20 about the status of the poolside alarm, the results of the most recent poolside self-test, and the status of the poolside battery. An RF address switch 164 provides protection from RF interference by decoding a unique 10 bit address value which is sent by the poolside unit as a preamble to each data transfer. The power supply circuit 165 informs the processor when the monitor unit 21 is running on battery backup so that the monitor software can enter a power conserving state.

The microprocessor 160 controls status LEDs 161 and a monitor alarm circuit 162 via its digital outputs. The status LEDs 161 reflect the alarm state, the condition of both the poolside and monitor batteries, the result of the most recent poolside self-test, and the status of the communications link between the poolside unit 20 and the monitor unit 21. With the exception of monitor battery status, the monitor unit 21 receives the data which drives the status LEDs from the poolside unit via the RF signal received by the RF receiver 163. Monitor battery status is derived from a voltage comparator within the monitor unit 21.

Figure 14:
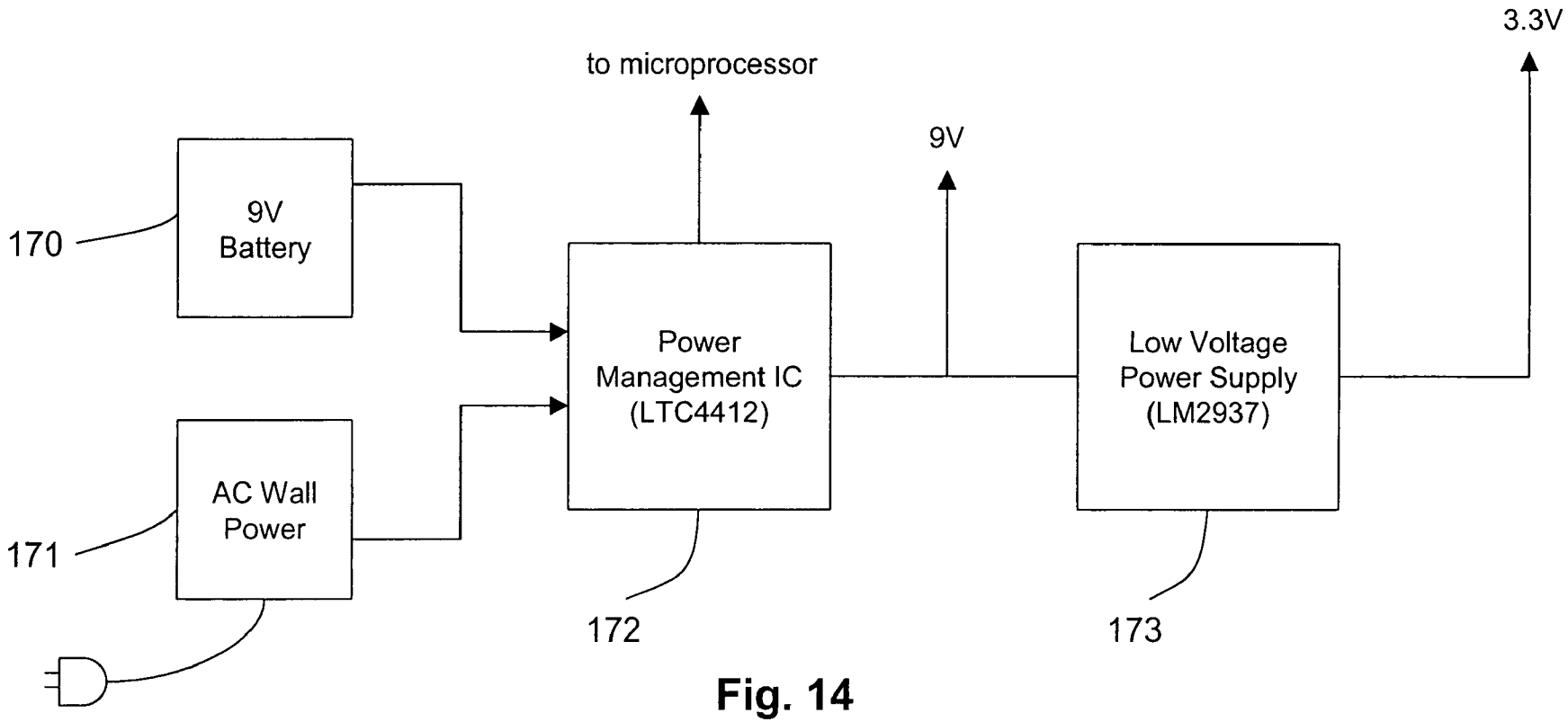
FIG. 14 is a block diagram of an implementation of the monitor unit power supply.

FIG. 14 shows a block diagram of an implementation of the monitor unit power supply 165. The monitor unit 21 is primarily powered from an AC line by a 9V DC wall plug mounted power supply 171. In the event of an AC power failure, the unit 21 is powered by a 9V battery 170 housed within the unit 21. A power management integrated circuit 172 coordinates the switch over between AC and battery power. The power management IC 172 also informs the microprocessor 160 as to which power source is currently powering the unit 21. A low dropout voltage regulator 173 converts the raw 9V DC supply voltage to a regulated 3.3V DC for the microprocessor 160 and related circuitry.

Figure 15:
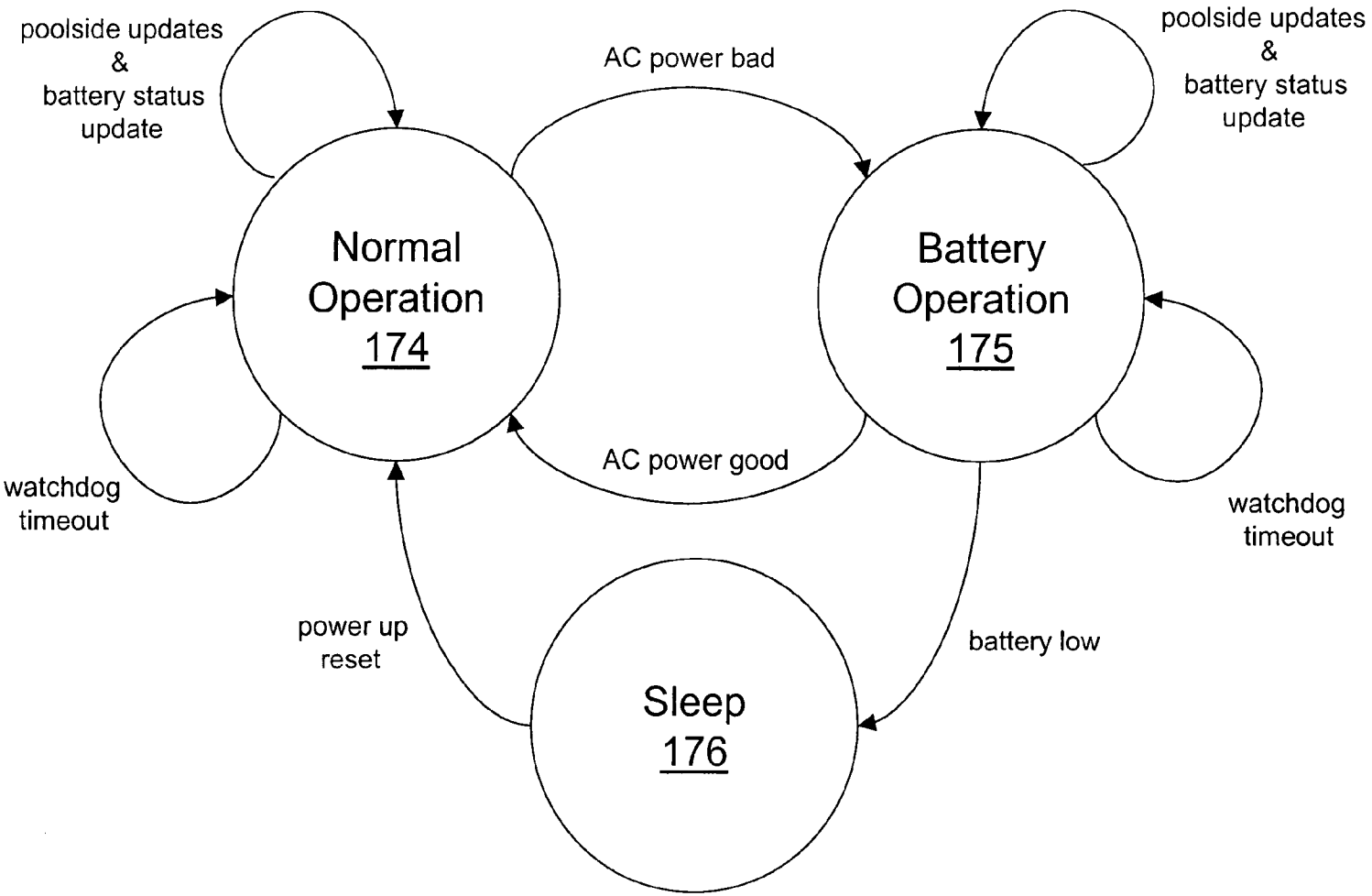
FIG. 15 is a state transition diagram for the monitor unit.

FIG. 15 is a state transition diagram showing the operation of the monitor unit 21. The normal operation state 174 is in effect when the monitor unit 21 is running on AC power. In this state 174, the LEDs that reflect the status of the system are illuminated continuously. When AC power is not available, the monitor unit 21 enters the battery operation state 175. In this state 175, all functions are available, however, the status LED's are illuminated intermittently to conserve battery life. When AC power is restored, the monitor unit 21 re-enters the normal operation state 174. If battery voltage drops below a set threshold when the monitor unit 21 is in the battery operation state 175, the processor is stopped and the unit 21 is powered down to a sleep state 176 until sufficient voltage is present, via the battery or the AC supply.

Other embodiments are within the scope of the following claims.

What is claimed is:

1. A pool monitoring system comprising:

a hydrophone configured to generate an electrical signal in response to receiving a sound pressure wave in the liquid of a pool; and a processor configured to receive the electrical signal and generate a trigger signal, when the electrical signal includes a characteristic signature over a time period within a predetermined range of time periods, and determine a trigger level from a background noise level;

wherein the characteristic signature comprises a first frequency component, contained in a frequency spectrum of the electrical signal, within a low band, with a magnitude above the trigger level; and a second frequency component, contained in the frequency spectrum, within a high band, with a magnitude above the trigger level.

2. The system of claim 1 wherein the low band comprises a continuous band of frequencies that is a subset of the range 500 Hz to 2 kHz.

3. The system of claim 1 wherein the high band comprises a continuous band of frequencies that is a subset of the range 2.5 kHz to 5 kHz.

4. The system of claim 1 further comprising:

a first filter configured to pass the first component if the first component is within the low band; and a second filter configured to pass the second component if the second component is within the high band.

5. The system of claim 4 wherein the first filter and the second filter are electrical circuits.

6. The system of claim 4 wherein:

the electrical signal is digitized;

the frequency spectrum is calculated based on the digitized electrical signal; and the first filter and the second filter include processor instructions that operate on the calculated frequency spectrum.

7. A pool intrusion detection method comprising:

generating an electrical signal in response to receiving a sound pressure wave in the liquid of a pool;

generating a trigger signal in response to receiving the electrical signal when the electrical signal includes a characteristic signature over a time period within a predetermined range of time periods; and determining a trigger level from a background noise level;

wherein the characteristic signature comprises a first frequency component, contained in a frequency spectrum of the electrical signal, within a low band, with a magnitude above the trigger level; and a second frequency component, contained in the frequency spectrum, within a high band, with a magnitude above the trigger level.

8. The method of claim 7 wherein the low band comprises a continuous band of frequencies that is a subset of the range 500 Hz to 2 kHz.

9. The method of claim 7 wherein the high band comprises a continuous band of frequencies that is a subset of the range 2.5 kHz to 5 kHz.

10. The method of claim 7 further comprising storing a count of false alarms.

11. The method of claim 10 wherein the false alarms include receiving the electrical signal when the electrical signal includes a noise signature that is different from the characteristic signature.

12. The method of claim 10 wherein the false alarms include receiving the electrical signal when the electrical signal includes a noise signature over a time periods that is not within the predetermined range of time periods.

13. The method of claim 10 further comprising adjusting the trigger level in response to the count of false alarms increasing above a predetermined number.

14. The method of claim 10 further comprising adjusting the center frequencies of the low band and the high band in response to the count of false alarms increasing above a predetermined number.

15. A pool monitoring system comprising:

a hydrophone configured to generate an electrical signal in response to receiving a sound pressure wave in the liquid of a pool; and a processor configured to receive the electrical signal and generate a trigger signal, when the electrical signal includes a characteristic signature over a time period within a predetermined range of time periods;

wherein the characteristic signature comprises respective magnitudes of a plurality of frequency components in a frequency spectrum of the electrical signal.

16. A pool intrusion detection method comprising:

generating an electrical signal in response to receiving a sound pressure wave in the liquid of a pool; and generating a trigger signal in response to receiving the electrical signal when the electrical signal includes a characteristic signature over a time period within a predetermined range of time periods;

wherein the characteristic signature comprises respective magnitudes of a plurality of frequency components in a frequency spectrum of the electrical signal.

17. A pool monitoring system comprising:

a hydrophone configured to generate an electrical signal in response to receiving a pressure wave in the liquid of a pool; and a processor configured to receive the electrical signal and generate a trigger signal, when the electrical signal includes a characteristic signature over a time period within a predetermined range of time periods, where the characteristic signature comprises respective magnitudes of a plurality of frequency components in a frequency spectrum of the electrical signal.

18. The system of claim 17, wherein each of the plurality of frequency components is within a respective predetermined continuous frequency band, and the frequency bands do not overlap.

19. The system of claim 18, wherein a first of the frequency bands comprises a band of frequencies that is a subset of the range 500 Hz to 2 kHz and a second of the frequency bands comprises a band of frequencies that is a subset of the range 2.5 kHz to 5 kHz.

20. A pool intrusion detection method comprising:

generating an electrical signal in response to receiving a pressure wave in the liquid of a pool; and generating a trigger signal in response to receiving the electrical signal when the electrical signal includes a characteristic signature over a time period within a predetermined range of time periods, where the characteristic signature comprises respective magnitudes of a plurality of frequency components in a frequency spectrum of the electrical signal.

21. The method of claim 20, wherein each of the plurality of frequency components is within a respective predetermined continuous frequency band, and the frequency bands do not overlap.

22. The method of claim 21, wherein a first of the frequency bands comprises a band of frequencies that is a subset of the range 500 Hz to 2 kHz and a second of the frequency bands comprises a band of frequencies that is a subset of the range 2.5 kHz to 5 kHz.

* * * * *